US009803322B2

(12) United States Patent
Kuo et al.

(10) Patent No.: US 9,803,322 B2
(45) Date of Patent: Oct. 31, 2017

(54) METHOD FOR MANUFACTURING RIGHT-ANGLED PULP PRODUCT

(71) Applicant: GOLDEN ARROW PRINTING CO., LTD., New Taipei (TW)

(72) Inventors: Chien-Kuan Kuo, New Taipei (TW); Chun-Huang Huang, New Taipei (TW)

(73) Assignee: GOLDEN ARROW PRINTING CO., LTD., New Taipei (TW)

( * ) Notice: Subject to any disclaimer, the term of this patent is extended or adjusted under 35 U.S.C. 154(b) by 141 days.

(21) Appl. No.: 14/887,528

(22) Filed: Oct. 20, 2015

(65) Prior Publication Data

US 2017/0107671 A1 Apr. 20, 2017

(51) Int. Cl.

| | |
|---|---|
| ***D21J 3/12*** | (2006.01) |
| ***D21J 1/04*** | (2006.01) |
| ***D21J 1/06*** | (2006.01) |
| ***B65D 5/20*** | (2006.01) |
| ***B65D 5/42*** | (2006.01) |
| ***B65D 1/00*** | (2006.01) |
| *B65D 1/22* | (2006.01) |

(52) U.S. Cl.

CPC ..... *D21J 3/12* (2013.01); *B65D 1/00* (2013.01); *B65D 5/20* (2013.01); *D21J 1/04* (2013.01); *D21J 1/06* (2013.01); *B65D 1/225* (2013.01); *B65D 5/4266* (2013.01)

(58) Field of Classification Search

CPC ..... D21J 1/02; D21J 1/04; D21J 1/06; D21J 1/10; D21J 3/12; B65D 1/00; B65D 1/22; B65D 1/225; B65D 5/00; B65D 5/0015; B65D 5/20; B65D 5/2085; B65D 5/42; B65D 5/4266

USPC ..... 162/218, 221–225, 227, 230, 382, 387, 162/396–399, 415, 416; 229/406, 407, 229/930, 931

See application file for complete search history.

(56) References Cited

U.S. PATENT DOCUMENTS

| | | | | |
|---|---|---|---|---|
| 66,920 | A * | 7/1867 | Wheeler | D21J 5/00 162/227 |
| 2,634,046 | A * | 4/1953 | Weber | B65D 5/4266 229/116.5 |
| 5,337,916 | A * | 8/1994 | Voss | B65D 5/4266 229/182 |
| 2006/0293158 | A1* | 12/2006 | Hamano | B65D 5/243 493/143 |
| 2015/0007954 | A1* | 1/2015 | Huang | B65D 1/225 162/111 |

OTHER PUBLICATIONS

The Math Forum, Ask Dr. Math, Oct. 22, 1997 [http://mathforum.org/dr.math/].*

* cited by examiner

*Primary Examiner* — Eric Hug

(74) *Attorney, Agent, or Firm* — Chun-Ming Shih; HDLS IPR Services

(57) ABSTRACT

A method for manufacturing a right-angled pulp product uses a mixture of cellulose fibers as pulp. Steps in the method include taking the pulp to form a flat shape, pressing and heat-drying the flat-shaped pulp to form a pulp product having a plurality of troughs, taking out the pulp product, cutting off a burr around the pulp product, applying adhesive onto each of the troughs, and bending two adjacent plates at two sides of each trough to form a right angle and a fixed shape.

6 Claims, 5 Drawing Sheets

200

METHOD FOR MANUFACTURING RIGHT-ANGLED PULP PRODUCT

TECHNICAL FIELD

The present invention relates to a pulp product manufacturing method and, in particular, to a method for manufacturing a right-angled pulp product.

BACKGROUND

A pulp product is made from cellulose fibers such as bamboo slurry or sugar cane slurry. Such plants have a short growth period, so planned planting can be accomplished, and an environmental impact is greatly reduced. The pulp product has excellent mouldability, so unlike paper products which have many restrictions on package designs, the pulp products can be produced in various shapes, and it is not necessary to adhere plastic onto the pulp products. A manufacturing process of the pulp product has a low carbon dioxide release rate, and the material can be recycled and reused completely, which meets the global environmental-friendly trend. Therefore, the pulp products are valued and adopted by industries and the public.

In recent years, the cellulose pulp products are extensively used, such as tableware, containers, packages, and especially degradable products. In manufacturing the cellulose pulp products, a mold is immersed in a pulp container. Pulp consisting of cellulose fibers is in a slurry form, so the pulp is easily drawn toward a mold having a plurality of suction holes and a metal screen on a surface of the mold, and then the pulp covers an outer surface of the metal screen, which is so called a mold-taking-pulp process.

After the mold has a sufficient amount of the pulp, the mold is removed from the pulp container and a mold combination dewatering process is performed to reduce moisture. When the moisture is reduced, a pressing and heat-drying process is performed. After the pulp in the mold is dried, a pulp product can be taken out (released from the mold). During the mold pressing or heat-drying process, the pressing force is in one direction only, i.e. a downward direction. Since the force cannot be applied to the lateral sides of the pulp, the following problems occur: 1. A base plate and side plates of the pulp product are of uneven density and thickness. 2. In a mold release process, it requires a draft angle to release the pulp product smoothly from the mold, so the pulp product cannot form a right angle at bends of the pulp product.

Accordingly, the inventor made various studies to improve the above-mentioned problems in the conventional manufacturing process, on the basis of which the present invention is accomplished.

SUMMARY

It is an object of the present invention to provide a method for manufacturing a right-angled pulp product with ease.

Accordingly, the present invention provides a method for manufacturing a right-angled pulp product from pulp consisting of a mixture of cellulose fibers. The method includes taking the pulp to form a flat shape, pressing and heat-drying the flat-shaped pulp to form a pulp product having a plurality of troughs, taking out the pulp product, cutting off a burr around the pulp product, applying adhesive onto each of the troughs, and bending two adjacent plates at two sides of each trough to form a right angle and a fixed shape.

The present invention also has the following effects. Since the flat-shaped pulp in one-sheet form is utilized in the pressing and heat-drying process, the pulp product is of even density and thickness. Therefore, it is not necessary to use a mold with a particular draft angle for mold release, and thereby the difficulty in shaping the right angle is overcome. Furthermore, the second mold in a flat shape is utilized in the process of directly pressing and heat-drying the pulp to form the pulp product having the plurality of troughs, so the pulp product has an average density of up to 0.8 to 1 kg/m$^3$, has a bekk smoothness of 6 to 14 seconds, and has an average thickness of 2 to 4 millimeters.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
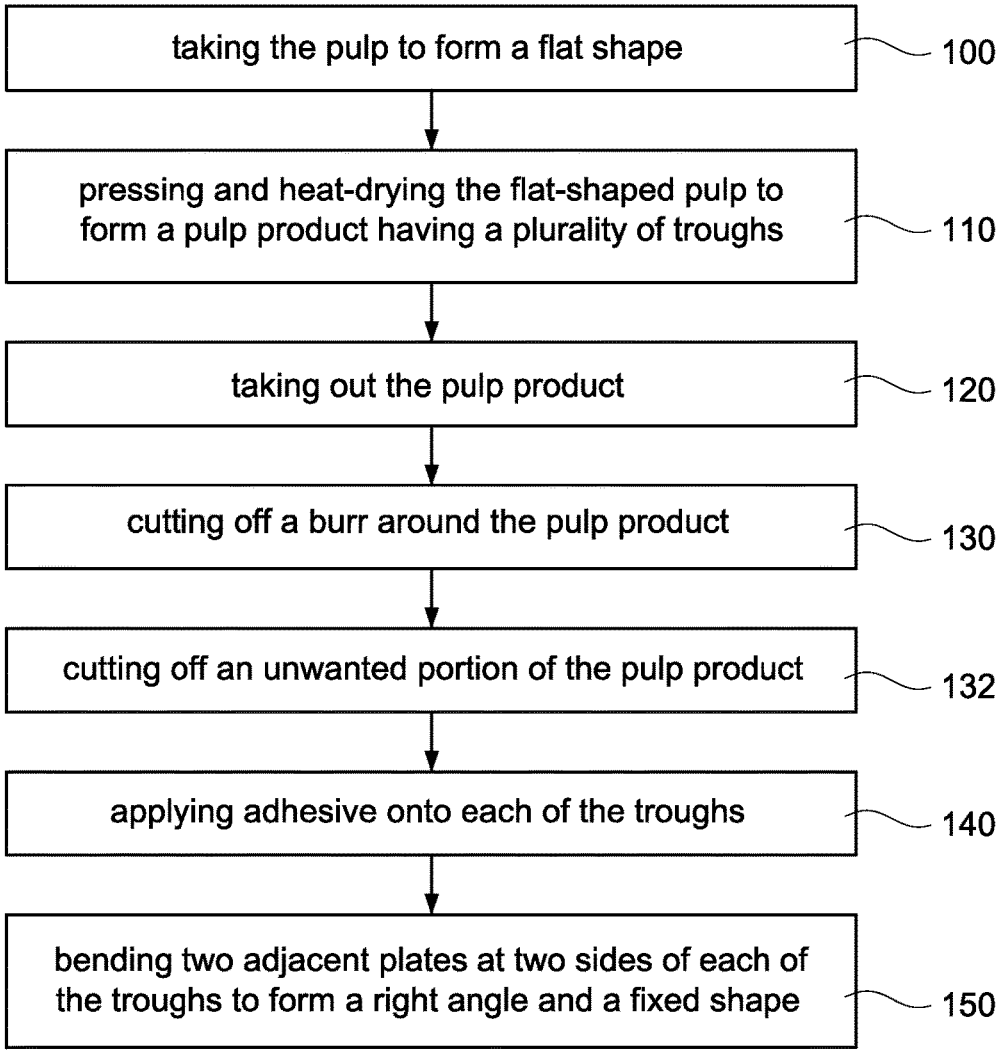
FIG. 1 is a flowchart illustrating a method for manufacturing a right-angled pulp product.

FIG. 1 is a flowchart illustrating a method for manufacturing a right-angled pulp product from pulp consisting of a mixture of cellulose fibers. The method includes the following steps. In step 100, the pulp is taken to form a flap shape. In step 110, the flat-shaped pulp is pressed and heat-dried to form a pulp product having a plurality of troughs. In step 120, the pulp product is taken out. In step 130, a burr around the pulp product is cut off. In step 140, adhesive is applied onto each of the troughs. In step 150, two adjacent plates at two sides of each trough are bent to form a right angle and a fixed shape.

Figure 2:
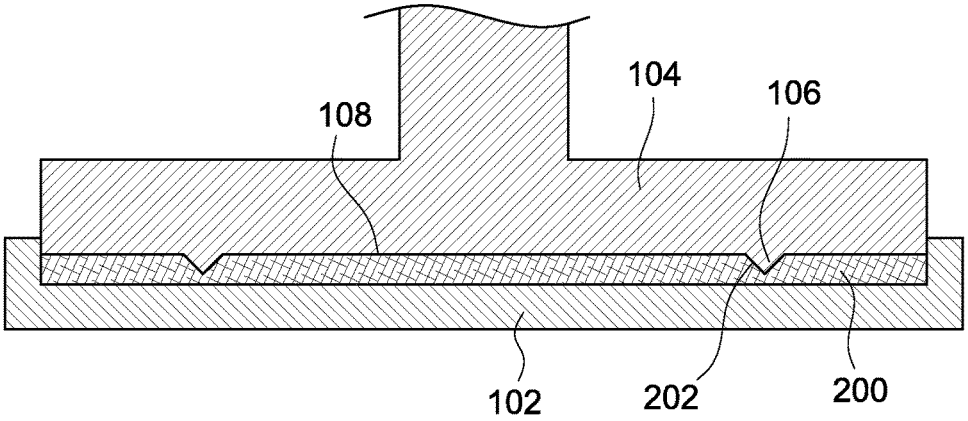
FIG. 2 is a cross-sectional view of the present invention, illustrating a second mold pressing and heat-drying pulp on a first mold.
Figure 3:
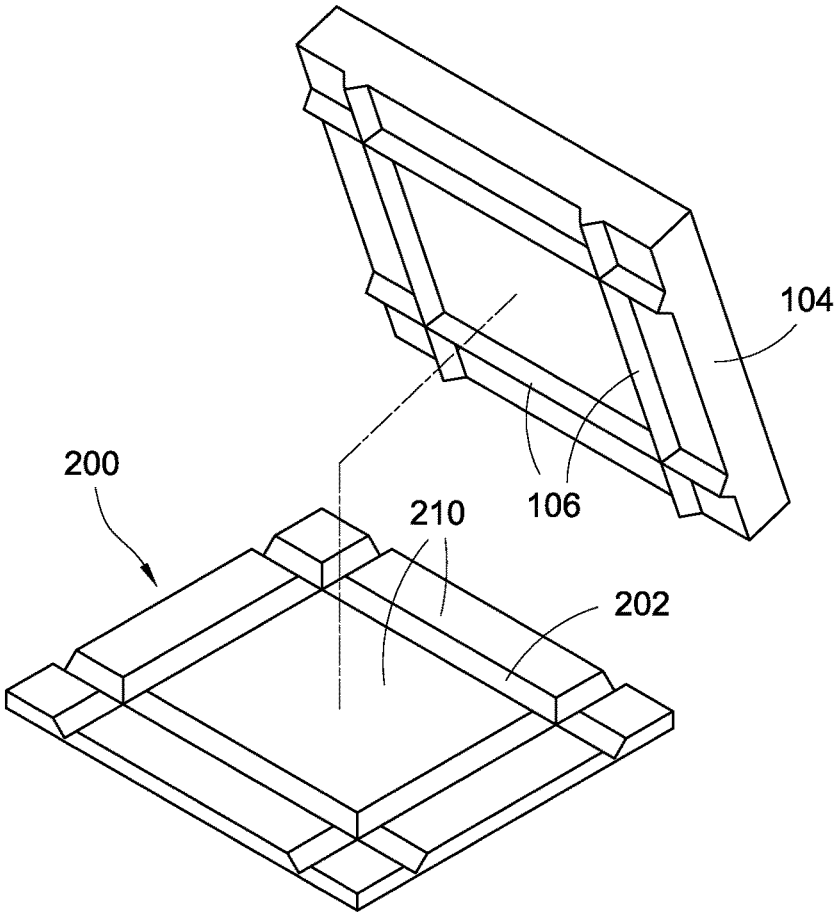
FIG. 3 is a perspective view of the present invention, illustrating the second mold and a pulp product.
Figure 4:
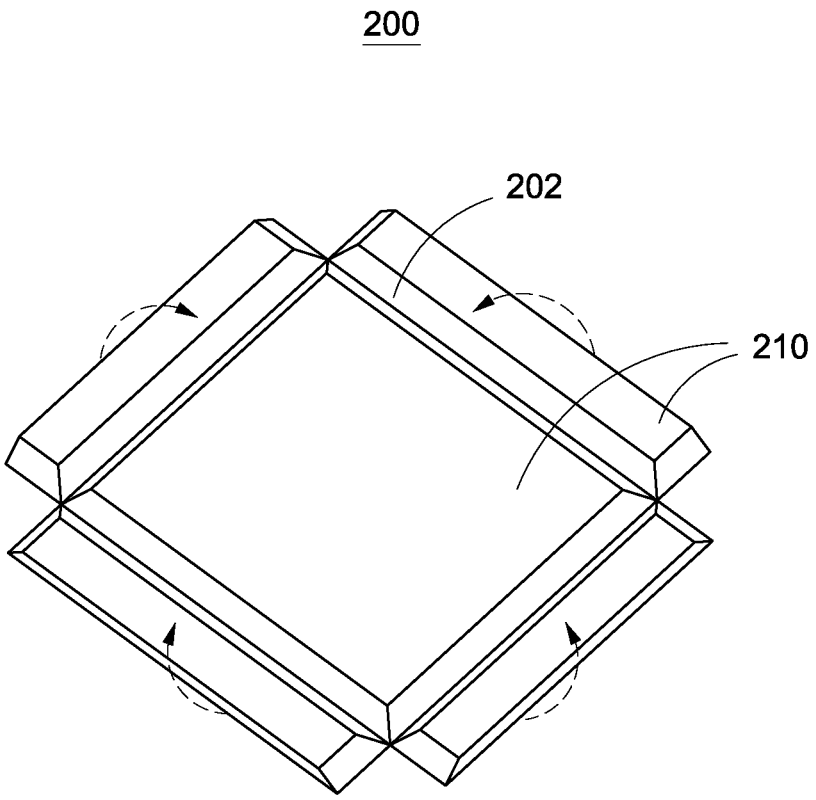
FIG. 4 is a perspective view of the present invention, illustrating bending two adjacent plates at two sides of each trough.

Referring to FIGS. 2 to 4, the method further comprises using a first mold 102 to take and hold the pulp to form the flat shape 108. In the present embodiment, the method further comprises pressing and heat-drying the flat-shaped pulp by a second mold 104 having a plurality of knurling portions 106, wherein the knurling portions 106 of the second mold 104 are disposed corresponding to the troughs 202, respectively.

Figure 5A:
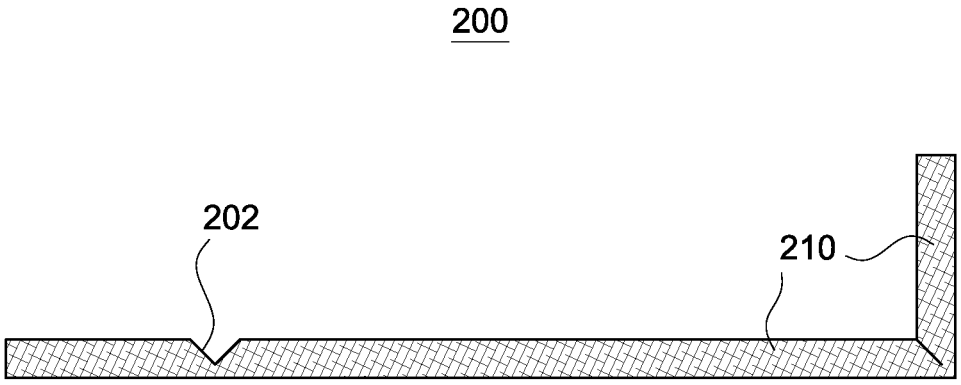
FIG. 5A is a side view of the present invention, illustrating the pulp product partially bent into shape.
Figure 5B:
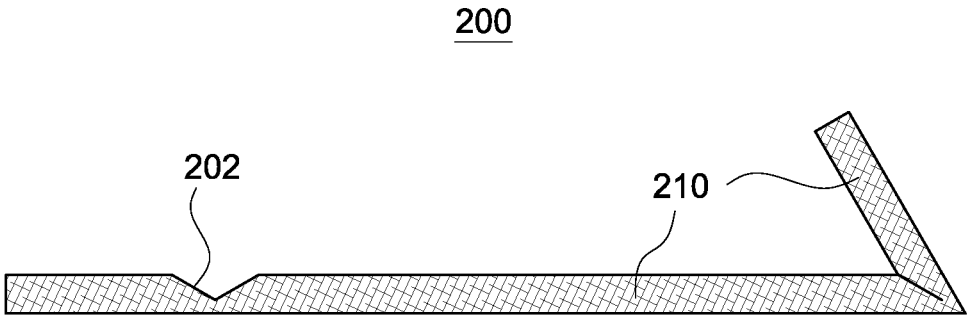
FIG. 5B is another side view of the present invention, illustrating the pulp product partially bent into shape.
Figure 6:
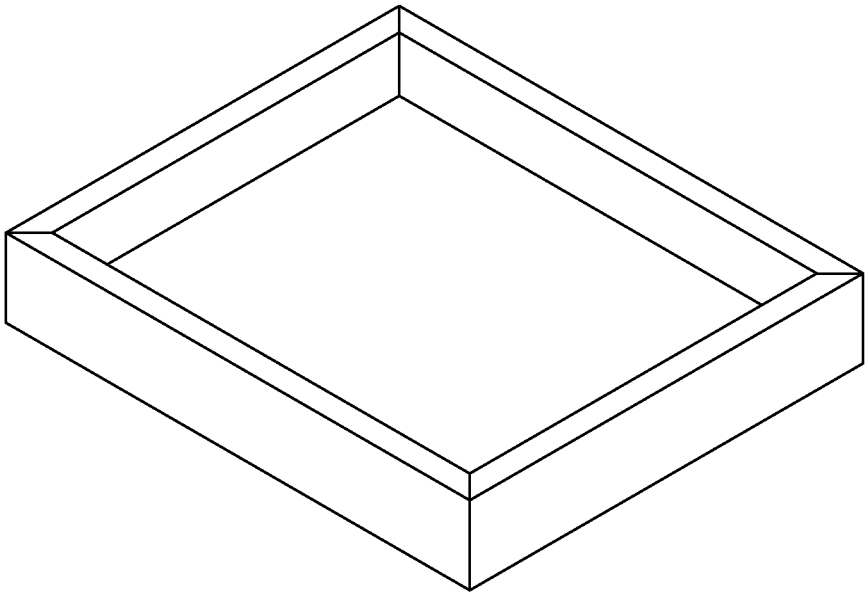
FIG. 6 is a perspective view of the present invention, illustrating the pulp product bent into a fixed shape.

Referring to FIGS. 1 and 6, after performing the step 130 of cutting off the burr of the pulp product, the method further comprises step 132. In the step 132, an unwanted portion of the pulp product is cut off to facilitate bending the two adjacent plates at two sides of each of the troughs to form the right angle or an angle smaller than the right angle. Referring to FIGS. 5A and 5B, the angle between the two plates 210 of the pulp product 200 can be 90 degrees or less than 90 degrees, for example, in a range from 45 to 90 degrees.

Since the flat-shaped pulp in one-sheet form is utilized in the pressing and heat-drying process, the pulp product is of even density and thickness, and two sides of the pulp product in one-sheet form are smooth. Therefore, it is not necessary to use a mold having a particular draft angle for mold release, and the difficulty in shaping the right angle is overcome.

Furthermore, the second mold in a flat shape is utilized in a process of directly pressing and heat-drying the pulp to form the pulp product having the plurality of troughs, so the pulp product has an average density of up to 0.6 $kg/m^3$ or above, has a bekk smoothness of 6 to 14 seconds, and has an average thickness of 2 to 4 millimeters, wherein the average density is preferably 0.8 to 1 $kg/m^3$, and the average thickness is preferably 3 millimeters.

It is to be understood that the above descriptions are merely the preferable embodiment of the present invention and are not intended to limit the scope of the present invention. Equivalent changes and modifications made in the spirit of the present invention are regarded as falling within the scope of the present invention.

What is claimed is:

1. A method for manufacturing a right-angled pulp product from pulp consisting of a mixture of cellulose fibers, comprising the steps of:

taking the pulp to form a flat shape;

pressing and heat-drying the flat-shaped pulp to form a pulp product having a plurality of troughs, and an average thickness of the pulp product being 2 to 4 millimeters;

taking out the pulp product;

cutting off a burr around the pulp product;

applying adhesive onto each of the troughs; and bending two adjacent plates at two sides of each of the troughs to form a right angle and a fixed shape.

2. The method for manufacturing the right-angled pulp product of claim 1, further comprising using a first mold to take and hold the pulp to form the flat shape.

3. The method for manufacturing the right-angled pulp product of claim 1, further comprising pressing and heat-drying the flat-shaped pulp by a second mold having a plurality of knurling portions.

4. The method for manufacturing the right-angled pulp product of claim 3, wherein the knurling portions of the second mold are disposed corresponding to the troughs, respectively.

5. The method for manufacturing the right-angled pulp product of claim 1, further comprising cutting off an unwanted portion of the pulp product after cutting off the burr of the pulp product to facilitate bending the two adjacent plates at two sides of each of the troughs to form the right angle or an angle smaller than the right angle.

6. The method for manufacturing the right-angled pulp product of claim 5, wherein the angle smaller than the right angle includes a range from 45 to 90 degrees.

* * * * *